US005971520A

United States Patent [19]

Nakahara

[11] Patent Number: 5,971,520

[45] Date of Patent: Oct. 26, 1999

[54] DRIVE TRANSMISSION SWITCHING MECHANISM FOR SWITCHING BETWEEN PAPER FEED AND PRINT HEAD RECOVERY

[75] Inventor: Junji Nakahara, Nagoya, Japan

[73] Assignee: Brother Kogyo Kabushiki Kaisha, Nagoya, Japan

[21] Appl. No.: 08/740,612

[22] Filed: Oct. 31, 1996

[30] Foreign Application Priority Data

Nov. 16, 1995 [JP] Japan ..... 7-323709

[51] Int. Cl.[6] ..... B41J 2/165

[52] U.S. Cl. ..... 347/30

[58] Field of Search ..... 347/30, 29, 32, 347/23

[56] References Cited

U.S. PATENT DOCUMENTS

| | | | |
|---|---|---|---|
| 5,432,538 | 7/1995 | Carlotta | 347/30 |
| 5,437,444 | 8/1995 | Kawakami et al. | 271/22 |
| 5,742,316 | 4/1998 | Hirano et al. | 347/30 |

FOREIGN PATENT DOCUMENTS

| | | | |
|---|---|---|---|
| 62-263058 | 11/1987 | Japan . | |
| 4-91959 | 3/1992 | Japan . | |
| 6-262768 | 9/1994 | Japan | 347/32 |

*Primary Examiner*—N. Le
*Assistant Examiner*—Thien Tran
*Attorney, Agent, or Firm*—Oliff & Berridge, PLC

[57] ABSTRACT

A drive transmission mechanism in a recording apparatus in which after a drive force transmission gear is meshed with a negative pressure gear, the meshing state of both the gears can be held during maintenance operation irrespective of movement and position of a carriage. When a rib of the carriage kicks a kick portion, a drive force distributing gear (a drive force transmission gear) is released from a pressing force of an idle kicker and slidably moved by being biased by a compression spring. In a notch (cutaway) portion, meshing teeth are meshed with a purge gear (negative pressure gear). By this meshing, when the purge gear starts rotate, even if an idle kicker presses the meshing teeth during rotation, a collar portion suppresses the sliding movement of the meshing teeth, unless the notch portion rotates to a position corresponding to the meshing teeth (a home position), so that the purge gear is not disengaged from the meshing teeth.

16 Claims, 21 Drawing Sheets

Fig.6A
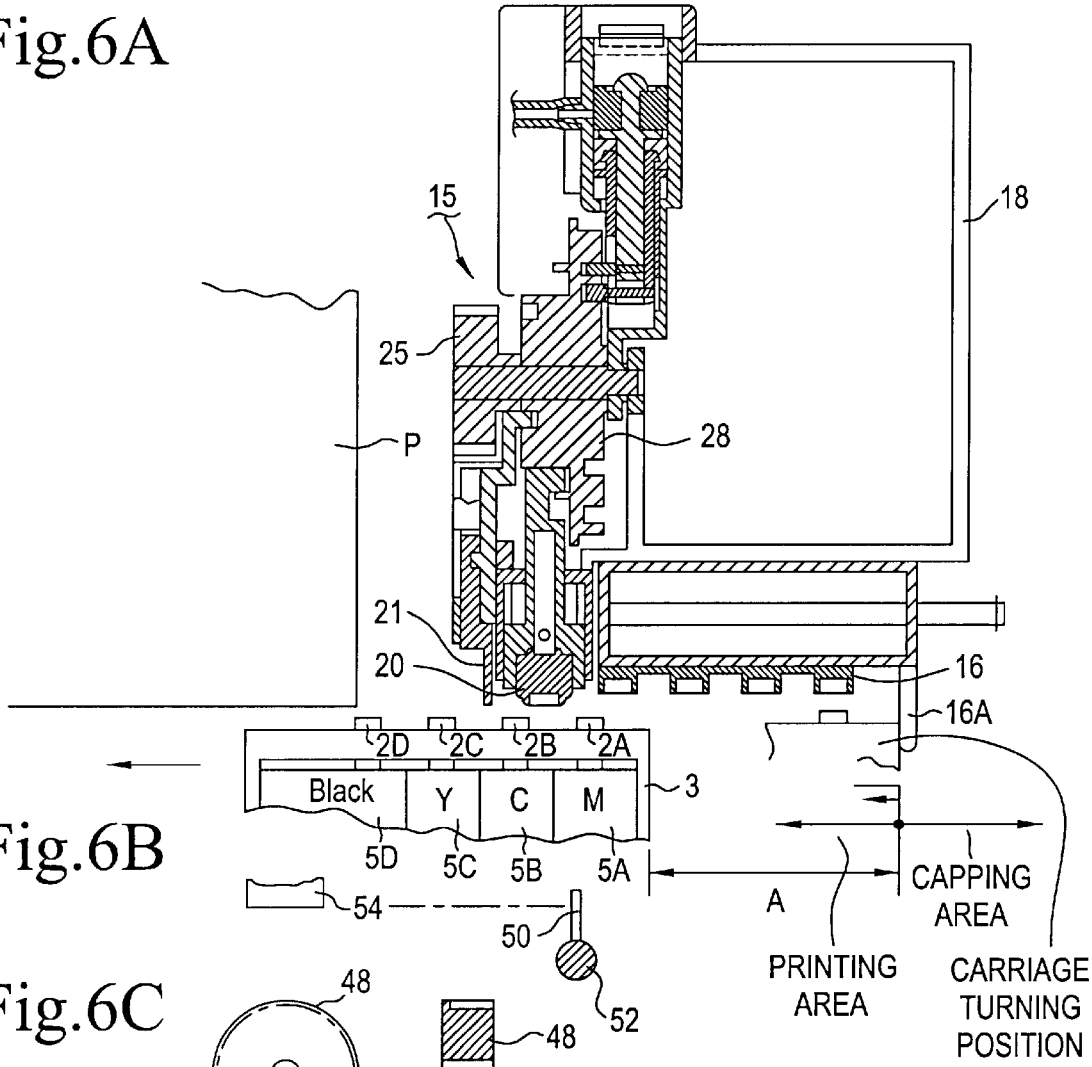
Fig.6B
Fig.6C
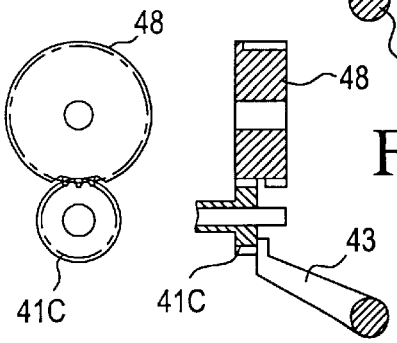
Fig.6D

Fig.9A
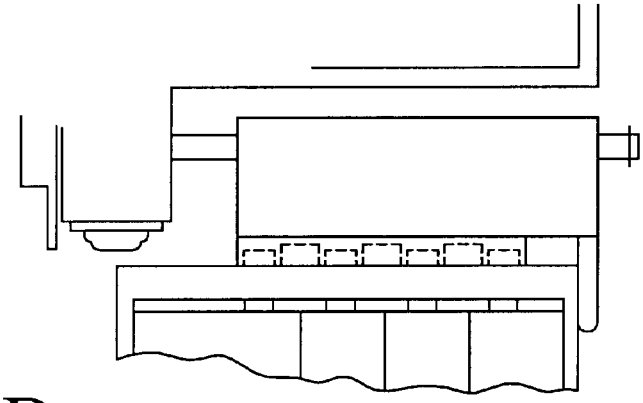
Fig.9B
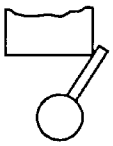
Fig.9C
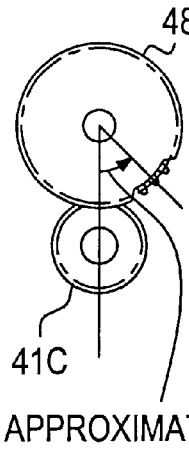
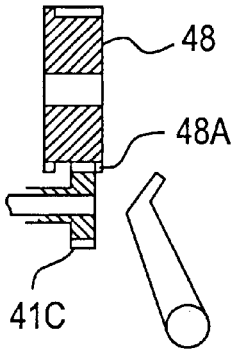
Fig.9D

Fig.11A-1
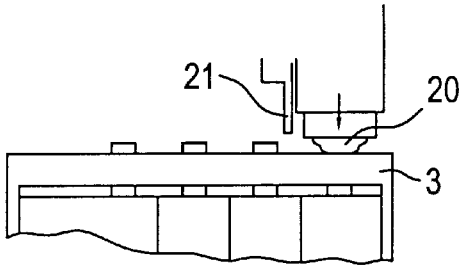
Fig.11A-2
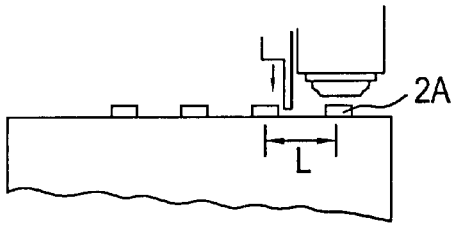
Fig.11A-3
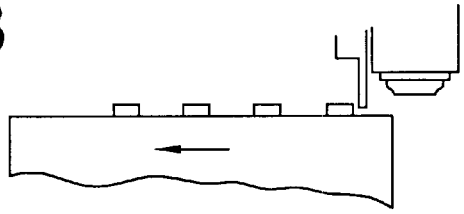
Fig.11A-4
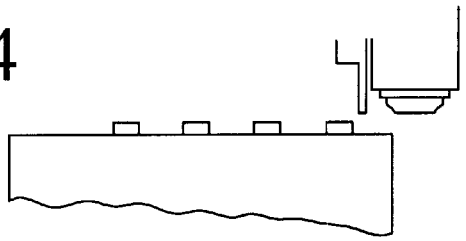
Fig.11B
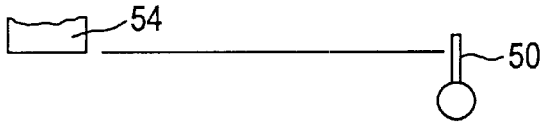
Fig.11C
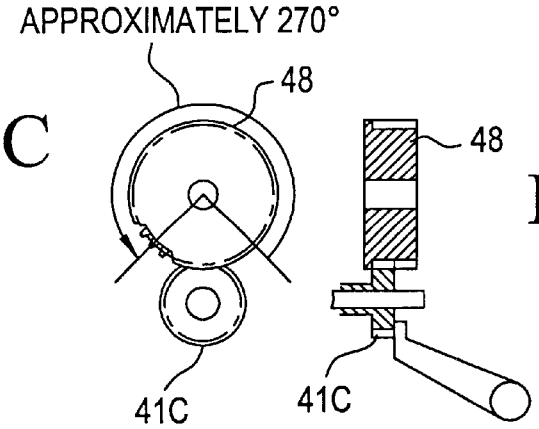
Fig.11D Fig.13 A
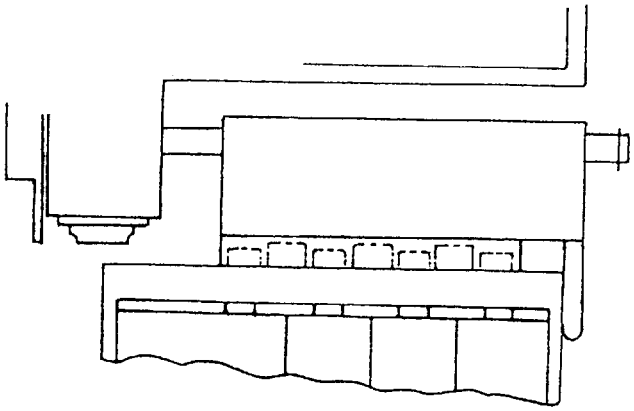
Fig.13 B
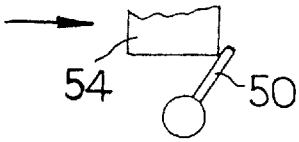
Fig.13 C
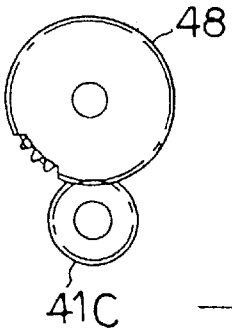
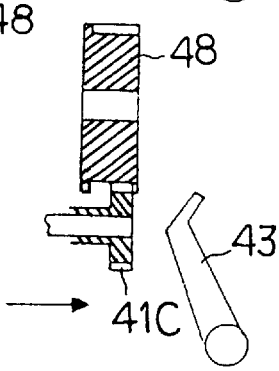
Fig.13 D Fig.14 A
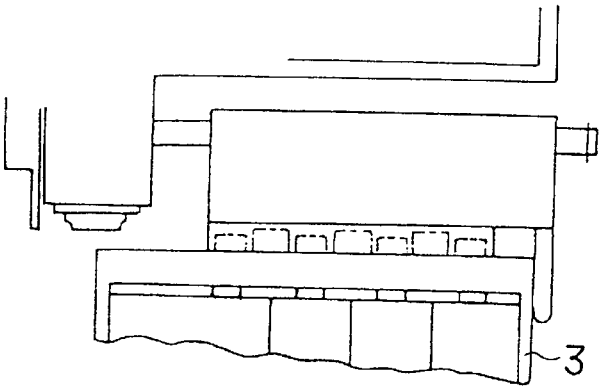
Fig.14 B
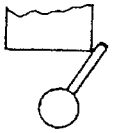
Fig.14 C
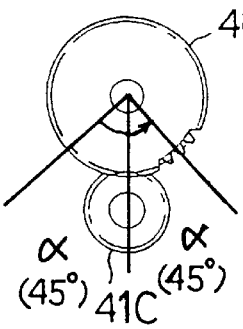
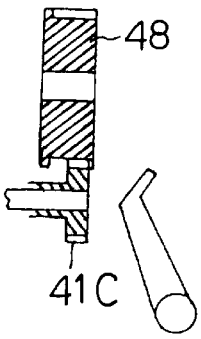
Fig.14 D Fig.16 A
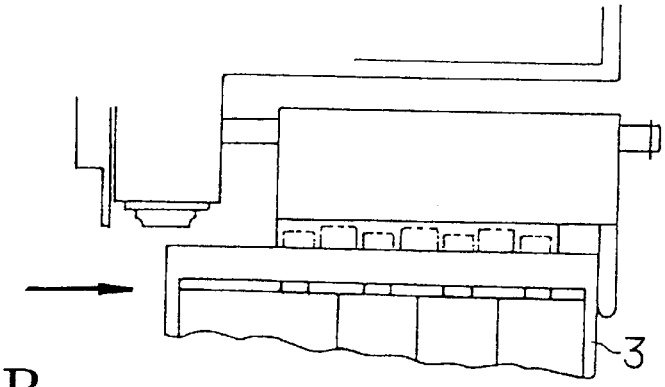
Fig.16 B
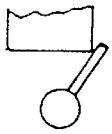
Fig.16 C
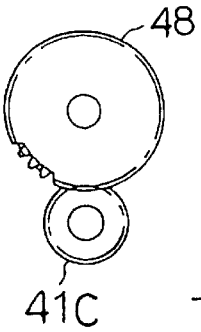
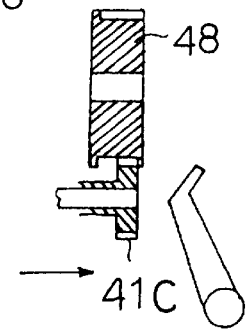
Fig.16 D Fig.18A
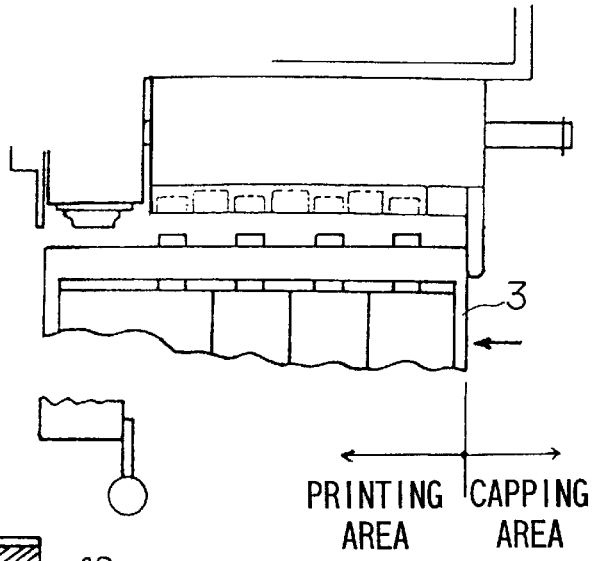
Fig.18B
Fig.18C
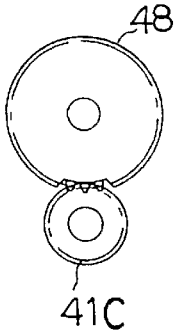
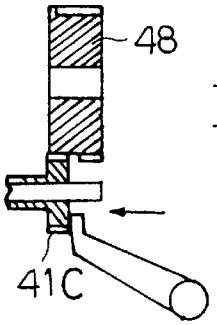
Fig.18D

DRIVE TRANSMISSION SWITCHING MECHANISM FOR SWITCHING BETWEEN PAPER FEED AND PRINT HEAD RECOVERY

BACKGROUND OF THE INVENTION

1. Field of the Invention

The invention relates to a drive transmission switching mechanism in a recording apparatus, such as an ink jet printer, a facsimile and the like, and particularly to a drive transmission switching mechanism for switching to a state for transmitting a drive force of a driving source to negative pressure generating means and to a state for not transmitting it.

2. Description of Related Art

In the past, in recording apparatuses, such as an ink jet printer, a defective discharge occurs because bubbles occur in a printing head during use or ink droplets adhere to the surface of a nozzle. For the purpose of overcoming these problems and restoring a state to a good discharge state, the apparatus is provided with a maintenance device called a purge device. The purge device is designed so that a suction cap is placed over the printing head, and a negative pressure is generated by a pump to suck defective ink from within the printing head. It is known that a driving source, as means for generating the negative pressure, is used in common with a driving source for carrying a recording medium, such as printing paper, to reduce the number of parts and to reduce the cost.

The recording apparatus which uses in common the driving sources for the negative pressure generating means and the recording medium carrying means is provided with a drive transmission switching mechanism for switching the transmission of the drive force to the state where, when the negative pressure generating means is actuated, the drive force of the driving source can be a negative pressure transmitted to the generating means. In the drive transmission switching mechanism, a drive force transmission gear to which the drive force of the driving source is transmitted is selectively meshed with a drive gear of negative pressure generating means (hereinafter referred to as a negative pressure gear) or a drive gear of recording medium carrying means (hereinafter referred to as a carrying gear) whereby the drive force is transmitted to one or both of the gears. The transmission of the drive force to the negative pressure generating means by the drive force transmission gear is accomplished by moving the drive force transmission gear to a position meshed with the negative pressure gear when a carriage, having a printing head mounted thereon, moves to a position at which the printing head is capped by a protective cap provided on the recording apparatus (hereinafter referred to as a capping position).

However, in the above-described conventional drive transmission switching mechanism, in the case where the carriage moves from the capping position to another position, the drive force transmission gear is disengaged from the negative pressure gear even during the operation of the negative pressure generating means. Accordingly, in the case where the carriage is at the capping position, the power supply is turned off during the restoring operation with respect to the nozzle portion, and the user manually moves the carriage to a position other than the capping position during the turning-off of the power supply, the drive force transmission gear is disengaged from the negative pressure gear despite the fact that the restoring operation is not yet finished. Thus, it is difficult to return to the original operating state causing problems with recording by the recording apparatus. Further, in the case where the drive transmission switching mechanism as described above is provided on the color printer having a plurality of printing heads for jetting a plurality of colors of ink drops, when the restoring operation is sequentially carried out with respect to the nozzle portions of the printing heads by a single purge device, the carriage needs to sequentially move the nozzle portions of each of the printing heads to the position opposed to the purge device. Therefore, when the drive force transmission gear is disengaged from the negative pressure gear, it is not possible to smoothly carry out the restoring operation with respect to all the nozzle portions.

SUMMARY OF THE INVENTION

The invention has been accomplished in order to solve the aforementioned problems. An object of the invention is to provide a drive transmission switching mechanism in a recording apparatus in which, after a drive force transmission gear is once meshed with a negative pressure gear, the meshing state between both the gears is maintained during the maintenance operation irrespective of the movement and the position of a carriage thereby transmitting the drive force of the driving source to negative pressure generating means.

To achieve the aforesaid object, the invention provides a recording apparatus comprising negative pressure generating means for generating negative pressure in a suction cap for covering a nozzle portion of a printing head; recording medium carrying means for carrying a recording medium; a driving source for driving the negative pressure generating means and the recording medium carrying means; and a drive transmission switching means for switching a drive force of the driving source into a state for transmitting the drive force and into a state for not transmitting the driving force; and further comprising a drive force transmission gear to which the drive force of the driving source is transmitted; a negative pressure gear for transmitting the drive force of the driving source from the drive force transmission gear to the negative pressure generating means; drive transmission switching means for axially slidably moving at least one gear of the drive force transmission gear and the negative pressure gear to enable switching into a position to be meshed with the other gear and into a position to be disengaged therefrom; and allowing means for allowing the sliding movement of the one gear from the meshing position to the disengaging position by the drive transmission means and the sliding movement from the disengaging position to the meshing position.

In the above-described arrangement, the sliding movement is effected so that either the drive force transmission gear or the negative pressure gear is meshed with or disengaged from the other gear is only allowed at a specific rotational position of the negative pressure gear. Therefore, when the drive force transmission gear and the negative pressure gear are once meshed with each other and start to rotate, both of the gears are not disengaged till the negative pressure gear again assumes the specific rotational position. Accordingly, the movement of the carriage necessary for the maintenance operation of the printing head can be carried out while maintaining the state where the drive force of the driving source is transmitted to the negative pressure generating means. Further, even in the case where the user manually moves the carriage to a position other than the capping position during the turning-off of power supply of the recording apparatus, the drive force transmission gear is not disengaged from the negative pressure gear till the operation of the negative pressure generating means is completed, thus reducing the cause of trouble of the recording apparatus.

Further, in the drive transmission switching mechanism in the recording apparatus according to the invention, the allowing means comprises a collar provided on the meshing teeth side of the negative pressure gear adjacent to the drive force transmission gear and having a shape with a part of an outer periphery thereof cutaway.

In the above-described arrangement, the sliding movement effected in order that either the drive force transmission gear or the negative pressure gear is meshed with or disengaged from the other gear is merely allowed at the portion of the cutaway shape of the collar portion of the negative pressure gear. When the drive force transmission gear and the negative pressure gear are meshed with each other and start to rotate, even if an attempt is made to carry out the sliding movement during the rotation of both of the gears, both the gears cannot be disengaged since the movement of the drive force transmission gear is suppressed by the negative gear collar portion, and the meshing state therebetween can be held.

Further, in the drive transmission switching mechanism in the recording apparatus according to the invention, the drive force transmission gear remains at the cutaway portion of the collar when the former is disengaged from the meshing teeth of the negative pressure gear by the sliding movement.

In the above-described arrangement, in the case where the drive force of the driving source is transmitted to only the recording medium carrying means, when the drive force transmission gear is disengaged from the negative pressure gear, it is located at the cutaway portion of the negative pressure gear collar portion. Therefore, the drive force transmission gear does not mesh with the negative pressure gear as it is positioned at the cutaway portion of the negative pressure gear, which has no teeth, so that the negative pressure gear is not rotated. Accordingly, the drive force transmission gear can be placed in smooth meshing with the negative pressure gear, and in addition, the distance required for the sliding movement by which the drive force transmission gear is disengaged from or meshed with the negative pressure gear can be reduced, as a result of which the moving time can be shortened through that portion.

Further, in the drive transmission switching mechanism in the recording apparatus according to the invention, the allowing means comprises a collar portion provided to be rotated integrally with the negative pressure gear and having a shape with a part of an periphery thereof cutaway, and a disk-like portion provided to be rotated integrally with the drive force transmission gear adjacent to the collar portion and capable of being fitted in the cutaway portion of the collar portion.

In the above-described arrangement, after the drive force transmission gear and the negative pressure gear are meshed with each other by the sliding movement, even if both the gears are attempted to effect the sliding movement, the sliding movement is suppressed till the notch portion of the negative pressure gear collar portion rotates to a position capable of being fitted in the disk-like portion on the drive force transmission gear side so that both the gears can not be disengaged from each other. Thus, the meshing state can be maintained.

Further, in the drive transmission switching mechanism in the recording apparatus according to the invention, the disk-like portion maintains the state of being fitted in the cutaway portion of the collar portion when the former is disengaged from the meshing teeth of the negative pressure gear by the sliding movement of the drive force transmission gear.

In the above-described arrangement, when the drive force transmission gear is disengaged from the meshing teeth of the negative pressure gear by the sliding movement, the disk-like portion is maintained in the state of being fitted in the notch portion of the collar portion. Therefore, after the drive force transmission gear is disengaged from the negative pressure gear, the negative pressure gear can be made so that it is not rotated either normally or the reverse.

Further, in the drive transmission switching mechanism in the recording apparatus according to the invention, the drive transmission switching means axially slidably moves at least one gear of the drive force transmission gear and the negative pressure gear as the carriage, having the printing head mounted thereon, moves outside the printing area to switch the gear from a position disengaged from the other gear to a meshing position.

In the above-described arrangement, in the case where the carriage moves outside the printing area, the drive force transmission gear and the negative pressure gear are meshed with each other. Therefore, only in the case where the carriage moves to the position for carrying out the maintenance with respect to the printing heads, is it possible to transmit the drive force of the driving source from the drive force transmission gear to the negative pressure gear.

Further, the drive transmission switching means is for axially slidably moving at least one gear of the drive force transmission gear and the negative pressure gear when a carriage having the printing head mounted thereon moves to a position at which the nozzle portion of the printing head is capped by a protective cap, provided outside of the suction cap, to switch the one gear from a position disengaged from the other gear to a meshing position.

Also, in the above-described arrangement, in the case where the carriage moves to a position at which the printing head is capped by the protective cap, the drive force transmission gear and the negative pressure gear are meshed with each other. Therefore, only in the case where the carriage moves to the position for carrying out the maintenance with respect to the printing heads is it possible to transmit the drive force of the driving source from the drive force transmission gear to the negative pressure gear.

Further, the drive transmission switching mechanism in the recording apparatus according to the invention, the carriage having the printing head mounted thereon has a plurality of printing heads for jetting different color inks mounted in a line in a moving direction of the carriage.

In the above-described arrangement, even in the case where the carriage moves in the direction of the printing area for carrying out the suction by the suction cap, with respect to the nozzle portions of the plurality of printing heads mounted on the carriage, the drive force transmission gear and the negative pressure gear can be maintained in the meshing state to maintain the state where the drive force of the driving source is transmitted to the negative pressure generating means.

According to the drive transmission switching mechanism in the recording apparatus according to the invention structured as described above, as the sliding movement effected in order that either the drive force transmission gear or the negative pressure gear is meshed with or disengaged from the other gear is merely allowed at a specific rotational position of the negative pressure gear, after the drive force transmission gear and the negative pressure gear are once meshed with each other, both of the gears are not disengaged until the negative pressure gear rotates and the specific rotational position again assumes a position corresponding to the drive force transmission gear. Accordingly, the movement of the carriage necessary for the maintenance operation of the printing head can be carried out while maintaining the state where the drive force of the driving source is transmitted to the negative pressure generating means. Further, even in the case where the user manually moves the carriage to a position other than the capping position during the turning-off of power supply of the recording apparatus, the drive force transmission gear is not disengaged from the negative pressure gear till the operation of the negative pressure generating means is completed, thus reducing the cause of trouble of the recording apparatus.

Further, the sliding movement effected in order that either the drive force transmission gear or the negative pressure gear is meshed with or disengaged from the other gear is merely allowed at a portion of the cutaway shape of the collar portion of the negative pressure gear. When the drive force transmission gear and the negative pressure gear are meshed with each other and start to rotate, even if an attempt is made to carry out the sliding movement during the rotation of both of the gears, the gears cannot be disengaged since the movement of the drive force transmission gear is suppressed by the negative gear collar portion. Thus, the state where the drive force of the driving source is transmitted to the negative pressure generating means can be maintained.

When the drive force transmission gear is disengaged from the negative pressure gear, it is located at the cutaway portion of the negative pressure gear collar portion and rotates at that position. Therefore, the drive force transmission gear is not meshed with the negative pressure gear despite the former being placed upon a part of the negative pressure gear so that the negative pressure gear is not rotated. Accordingly, the drive force transmission gear can be placed in smooth meshing with the negative pressure gear and, in addition, the distance required for the sliding movement by which the drive force transmission gear is disengaged from or meshed with the negative pressure gear can be reduced. As a result, the moving time can be shortened.

Further, after the drive force transmission gear and the negative pressure gear are meshed with each other by the sliding movement, even if an attempt is made to carry out the sliding movement during the rotation of both of the gears, the sliding movement is suppressed till the notch portion of the negative pressure gear collar portion rotates to a position capable of being fitted in the disk-like portion on the drive force transmission side and the gears cannot be disengaged. Accordingly, the state where the drive force of the driving source is transmitted to the negative pressure generating means can be maintained.

Further, when the drive force transmission gear is disengaged from the meshing teeth of the negative pressure gear by the sliding movement, the disk-like portion is maintained in the state fitted in the notch portion of the collar portion. Therefore, after the drive force transmission gear is disengaged from the negative pressure gear, the negative pressure gear can be made so that it is not rotated neither normally nor in reverse.

Further, in the case where the carriage moves outside the printing area, the drive force transmission gear and the negative pressure gear are meshed with each other. Therefore, only in the case where the carriage moves to the position for carrying out the maintenance with respect to the printing heads is it possible to transmit the drive force of the driving source from the drive force transmission gear to the negative pressure gear.

Further, in the case where the carriage moves to a position at which the printing head is capped by the protective cap, the drive force transmission gear and the negative pressure gear are meshed with each other. Therefore, only in the case where the carriage moves to the position for carrying out the maintenance with respect to the printing heads, is it possible to transmit the drive force of the driving source from the drive force transmission gear to the negative pressure gear.

Furthermore, even in the case where the carriage moves in the direction of the printing area for carrying out the suction by the suction cap with respect to the nozzle portions of the plurality of printing heads mounted on the carriage, the drive force transmission gear and the negative pressure gear can be maintained in the meshing state to transmit the drive force of the driving source to the negative pressure generating means.

BRIEF DESCRIPTION OF THE DRAWINGS

A preferred embodiment of the invention will be described in detail with reference to the following figures wherein:

FIGS. 6A, 6B, 6C and 6D are views showing a printing area and a capping area and relationships provided with the switching mechanism;

FIGS. 9A, 9B, 9C and 9D are views showing the state of the carriage, the purge device and the switching mechanism in the case where maintenance is performed with respect to a nozzle of a printing head;

FIGS. 11A-1, 11A-2, 11A-3, 11A-4, 11B, 11C and 11D are views showing the state of the carriage, the purge device and the switching mechanism in the case where maintenance is performed with respect to a nozzle of a printing head;

FIGS. 13A, 13B, 13C and 13D are views showing the state of the carriage, the purge device and the switching mechanism in the case where maintenance is performed with respect to a nozzle of a printing head;

FIGS. 14A, 14B, 14C and 14D are views showing the state of the carriage, the purge device and the switching mechanism in the case where maintenance is performed with respect to a nozzle of a printing head;

FIGS. 16A, 16D, 16C and 16D are views showing the state of the carriage, the purge device and the switching mechanism in the case where maintenance is performed with respect to a nozzle of a printing head;

FIGS. 18A, 18B, 18C and 18D are views showing the state of the carriage, the purge device and the switching mechanism in the case where maintenance is performed with respect to a nozzle of a printing head;

DETAILED DESCRIPTION OF THE PREFERRED EMBODIMENTS

Figure 1:
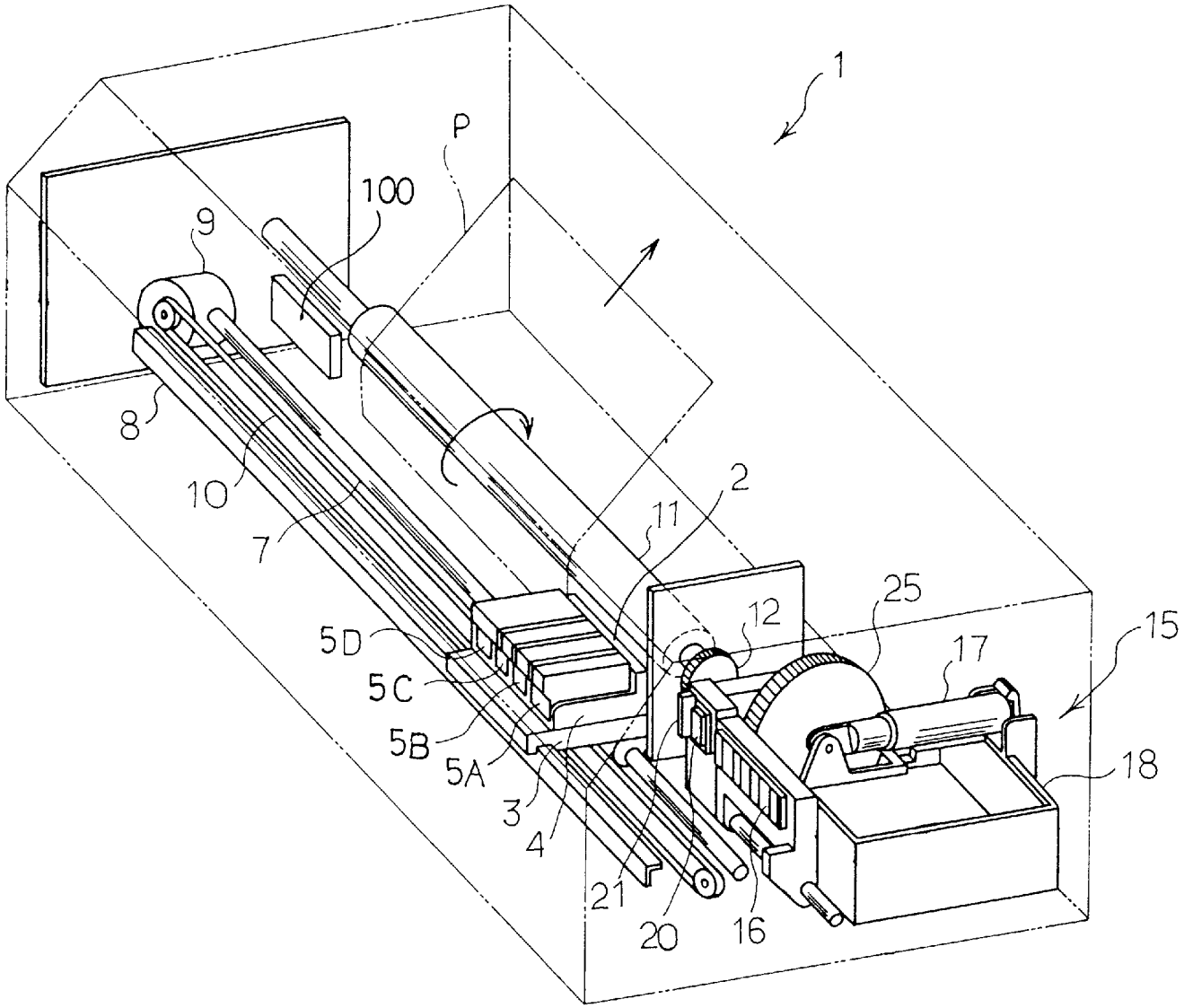
FIG. 1 is a perspective view showing a color ink jet printer provided with a drive transmission switching mechanism according to one embodiment of the invention.

The drive transmission switching mechanism according to one embodiment of the invention will be described hereinafter with reference to the figures. FIG. 1 is a perspective view showing a color ink jet printer provided with a drive transmission switching mechanism. The color ink jet printer (hereinafter referred to as a printer) will be described with reference to FIG. 1. A printer 1 is provided with an ink jet type printing head 2 for jetting four colors (cyan, magenta, yellow and black) onto a recording medium (hereinafter referred to as a printing paper P), such as printing paper for printing. The printing head 2 is provided with four nozzle portions (2A to 2D, FIG. 6A) having a plurality of nozzles for jetting the respective four color inks. The nozzle portions are held on a carriage 3 which is reciprocatingly driven linearly when printing. The printing head 2 is provided integrally with a head unit 4 and ink cartridges 5A, 5B, 5C, 5D for supplying the four color inks to the printing head 2. The ink cartridges 5A, 5B, 5C, 5D are detachably mounted on the carriage 3 together with the head unit 4. The carriage 3 is supported at its front portion on a carriage shaft 7 and is movable along the carriage shaft 7. The rear portion of the carriage 3 is slidably supported on a guide plate 8. The reciprocating movement of the carriage 3 is driven through a belt 10 by a carriage (CR) motor 9.

A platen roller 11 is provided at a position facing to the printing head 2. This platen roller 11 is driven when the drive force of a line field (LF) motor 40 (see FIG. 2) is transmitted by a platen gear 12. Printing paper P is carried to a position opposed to the printing head 2 by means of the platen roller 11 (which provides a recording medium carrying mechanism) and printing is carried out. A purge device 15 is provided a distance from an end of the platen roller 11. In the printing head 2, there sometimes occurs a defective discharge due to the generation of bubbles therein during use or adhesion of ink droplets to the discharge surface. For the purpose of overcoming such drawbacks and to restore the printing head 2 to a good discharge state, the purge device 15 is provided. The purge device 15 is also driven when the printing head 2 or the ink cartridges 5A to 5D are exchanged and functions so that ink within the cartridge is smoothly supplied to the nozzle of the printing head 2.

The purge device 15 will be further described in detail. The purge device 15 is provided at its front portion with a cap (a protective cap) 16. When the carriage 3 moves to a capping position, the cap 16 covers the nozzles of the printing head 2 to prevent ink from being dried. A suction cap 20 is provided to one side of the cap 16. The suction cap 20 sucks, when at least one set of the nozzles of the printing head 2 is covered, bubbles or defective ink in the printing head 2 using a negative pressure generated by a pump 17 to restore the printing head 2 (the suction cap 20 and the pump 17 providing a negative pressure generating mechanism). The thus sucked defective ink is fed to a storage portion 18. A wiper 21 for wiping the nozzle portion of the printing head 2 is provided to one side of the suction cap 20. The suction operation for the defective ink and the wiping operation are carried out with respect to each of four nozzle portions of the printing head 2. The purge device 15 is designed so that the required maintenance operations (suction and wiping) are executed during one rotation of a pump cam 28 (see FIG. 6), and a drive source thereof comprises the line feed motor 40 (providing a driving source) which is used common to the platen roller 11. The transmission of the drive force of the line feed motor 40 to the purge device 15 is effected in accordance with the position of the carriage 3. In the case of the transmission to the purge device 15, it is transmitted by a pump cam gear (a gear provided rotatably integral with the pump cam 28 to drive the latter) 25.

Figure 2:
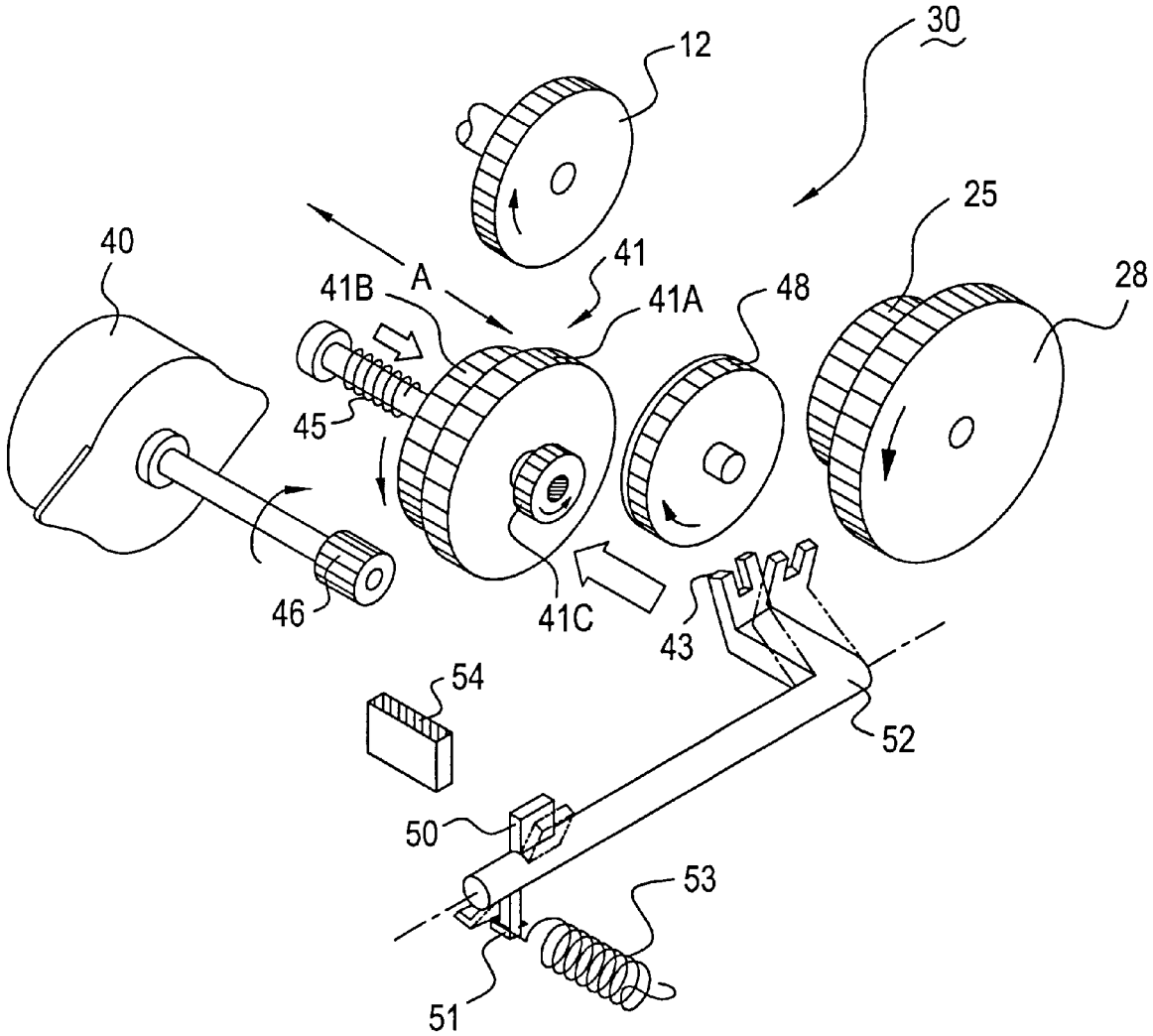
FIG. 2 is a perspective view showing gears of the switching mechanism.
Figure 3:
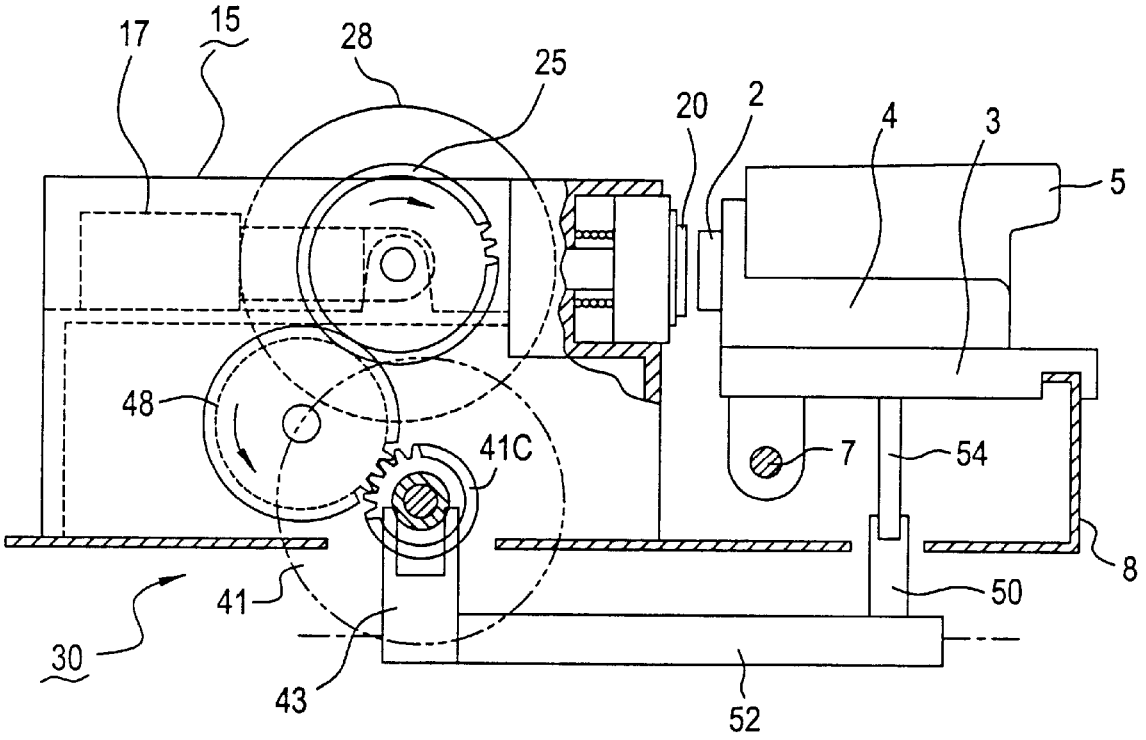
FIG. 3 is a side view showing a part of the gear, a carriage and a purge device of the switching mechanism.

Next, the drive transmission switching mechanism according to the invention, that is, the switching mechanism for switching the transmission of the drive force of the line feed motor 40 to the purge device 15 according to the position of the carriage 3 will be described with reference to FIGS. 2 and 3. FIG. 2 is a perspective view showing a group of gears of the switching mechanism 30, and FIG. 3 is a side view showing a part of gears, the carriage 3 and the purge device 15 of the switching mechanism 30.

The switching mechanism 30 has a drive force distributing gear (a drive force transmission gear) 41 which transmits the drive force of the line feed motor 40 and is movable in an axial direction (arrow A), an idle kicker 43 for pressing the drive force distributing gear 41 for movement in an axial direction, and a compression spring 45, as a first biasing mechanism for biasing the drive force distributing gear 41 to the right as shown by arrow A. In FIG. 2, parts are depicted separately for easy understanding but the parts are actually arranged close to each other.

The drive force distributing gear 41 has three sets of meshing teeth, that is, meshing teeth 41A meshed with a motor gear 46 mounted on an output shaft of the line feed motor 40, meshing teeth 41B meshed with the platen gear 12 coaxial with the platen roller 11, and meshing teeth 41C meshed with a purge gear (a negative pressure gear) 48 for transmitting the drive to the pump cam gear 25. The meshing teeth 41A, the meshing teeth 41B and the purge gear 48 are always meshed with the motor gear 46, the platen gear 12 and the pump cam gear 25, respectively, and the meshing teeth 41C are meshed with the purge gear 48 when the carriage 3 moves into a capping area (described later).

The idle kicker 43 is formed on a kicker shaft 52 provided rotatably along with a kick portion 50 and a spring hook 51 and assumes either a state indicated by the solid line or a state indicated by the two-dot contour line by the rotation of the kicker shaft 52. A pull spring 53 is engaged with the spring hook 51, and the idle kicker 43, the combination being a second biasing mechanism is biased to assume the state indicated by the solid line by the force of the pull spring 53. The force of the pull spring 53 is greater than that of the compression spring 45 (depicted by size of outline arrows in FIG. 2). The kick portion 50 is provided at a position which projects into the moving range of the carriage 3, and whose initial state is kept at an upright state. The carriage 3 is formed at the lower part with a rib (an engaging portion) 54 (or kicker engagement mechanism), which kicks the kick portion 50 when the carriage 3 moves to the capping area whereby the idle kicker 43 assumes the two-dot contour line. The idle kicker 43, the compression spring 45, the kick portion 50, the spring hook 51, the kicker shaft 52 and the pull spring 53 constitute the drive transmission means or drive transmission switch device.

Figure 4A:
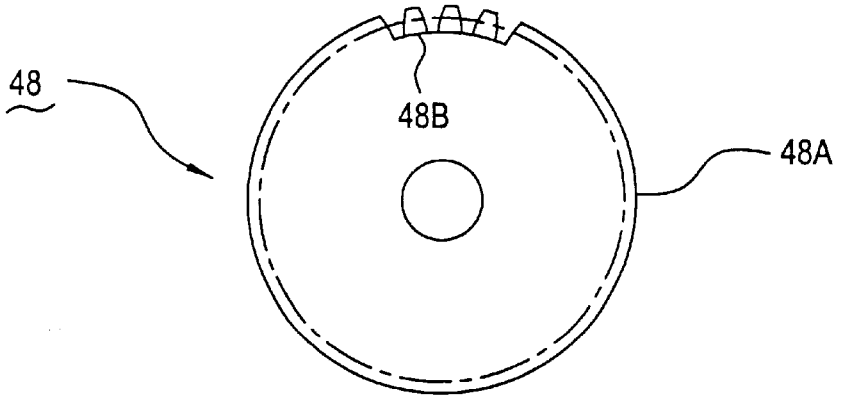
FIGS. 4A and 4B are side views showing a purge gear.
Figure 4B:
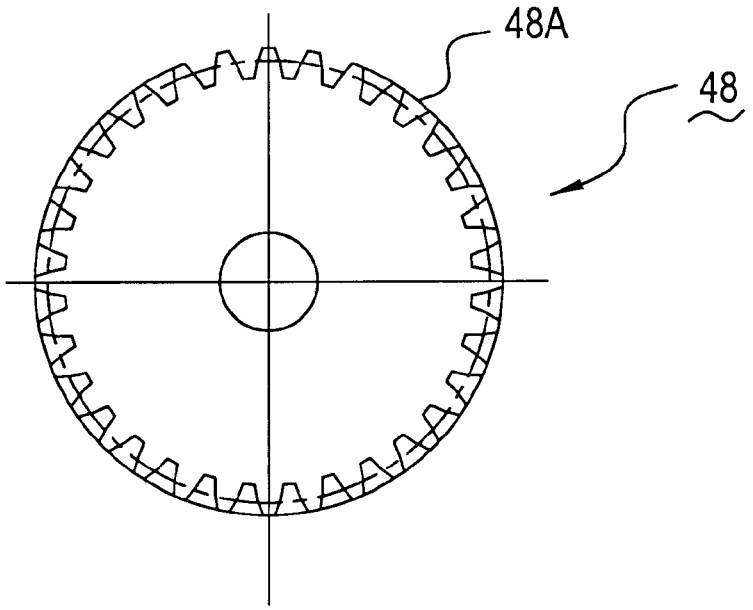
Figure 4C:
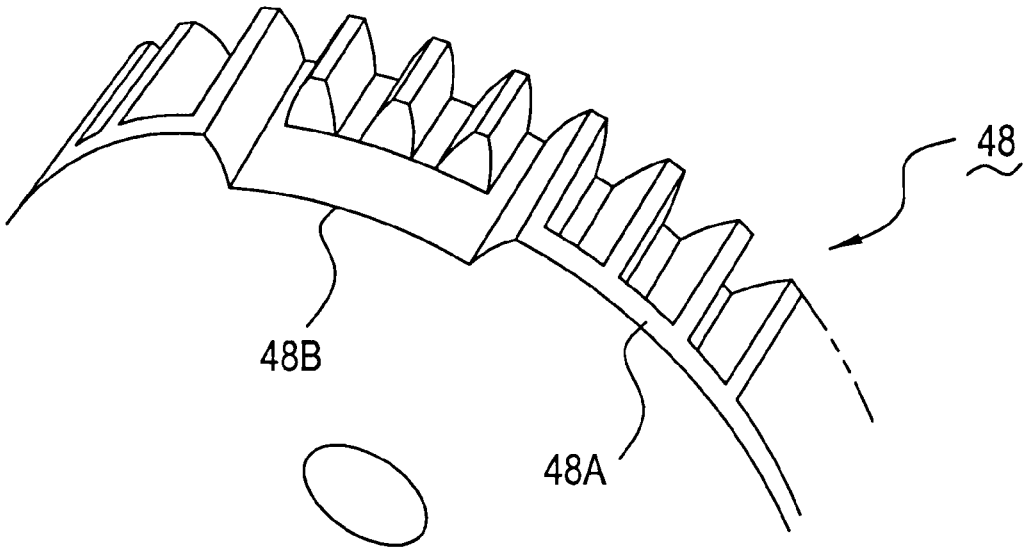
FIG. 4C is a perspective view showing the purge gear.

The shape of the purge gear 48 will be described below. FIGS. 4A and 4B are side views showing the purge gear 48, and FIG. 4C is a perspective view of the same. A collar 48A is provided on the side of the meshing teeth portion of the purge gear 48. The collar portion 48A (which is a locking mechanism) is provided only on the side of the meshing teeth of the surface adjacent to the drive force distributing gear 41, and a part thereof is provided with a notch portion 48B. The moving amount of the drive force distributing gear 41 is controlled by stopper means so that the drive force distribution gear 41 remains at the notch portion 48B in the case where the drive force distributing gear 41 is disengaged from the purge gear 48 while not being meshed. Accordingly, the sliding movement for the drive force distributing gear 41 meshed with or disengaged from the purge gear 48 by way of the idle kicker 43 is effected in the notch portion 48B, and the collar portion 48A and the notch portion 48B function as allowing means, an allowing mechanism for allowing the sliding movement.

In the above-described structure, when the carriage 3 is in the printing area, the idle kicker 43 is biased by the force of the spring 53 to assume a position indicated by the solid line in FIG. 2. At this time, the idle kicker 43 presses the drive force distributing gear 41 to the left as shown by arrow A (FIG. 2) against the bias of the compression spring 45. Therefore, the meshing teeth 41C do not mesh with the purge gear 48, and the pump cam gear 25 is in the not-driven state. On the other hand, when the carriage 3 moves into the capping area, the rib 54 kicks the kick portion 50 so that the idle kicker 43 is in the state indicated by the two-dot contour line in FIG. 2, whereby the bias of the pull spring 53 with respect to the drive force distributing gear 41 is released. At this time, the drive force distributing gear 41 is pressed to the right as shown by arrow A (FIG. 2) by the bias of the compression spring 45 so that the meshing gear 41C meshes with the purge gear 48. In this manner, the drive force of the line feed motor 40 can be transmitted to the pump cam gear 25, and the pump 17 is driven so that the suction by the suction cap 20 of the purge device 15 is carried out.

Figure 5B:
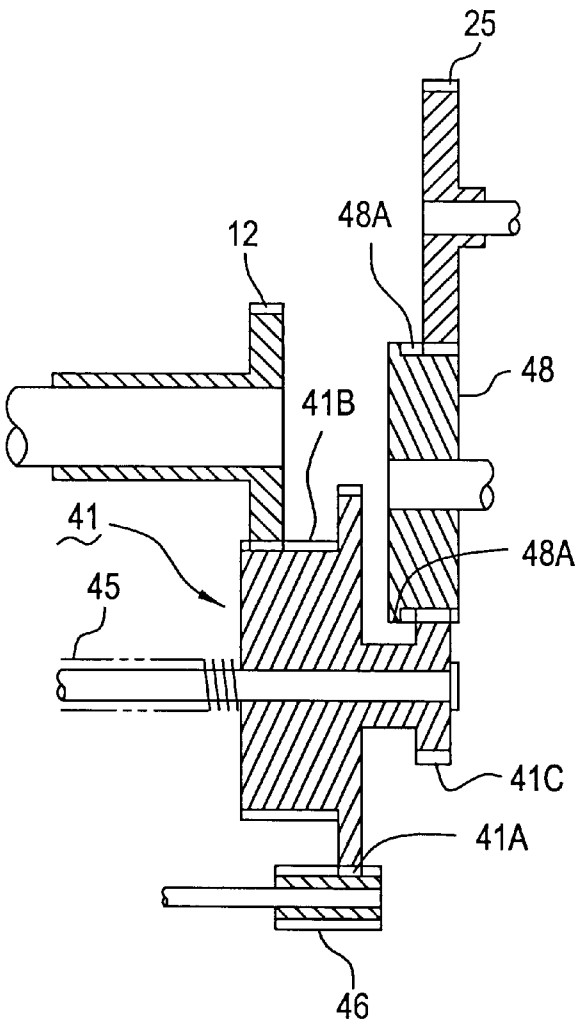
FIGS. 5A and 5B are schematic side sectional views showing the meshing of gears.
Figure 5A:
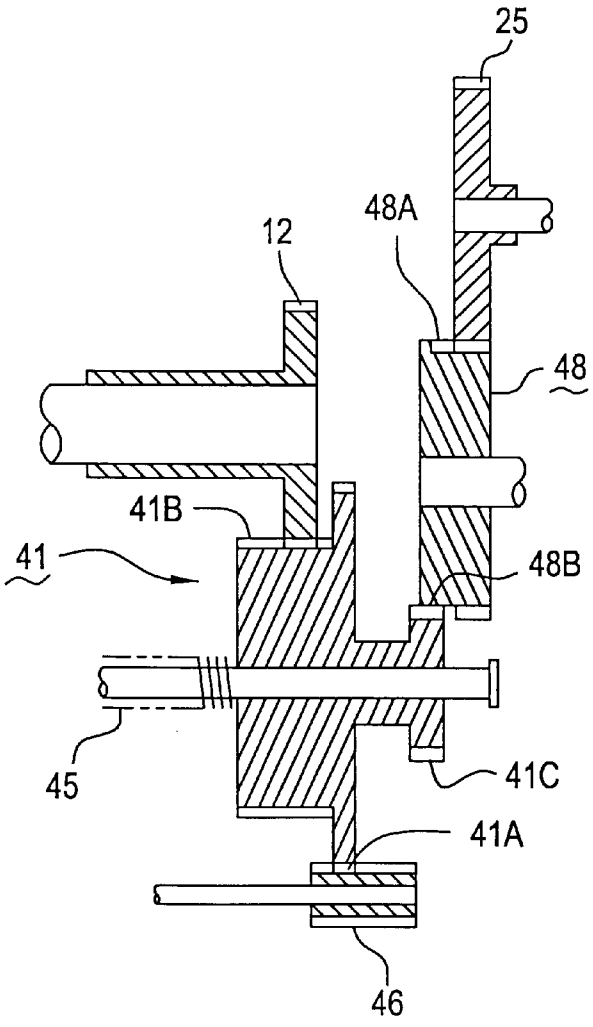

The meshing of the platen gear 12, the pump cam gear 25, the drive force distributing gear 41, the motor gear 46 and the purge gear 48 will be described. FIGS. 5A and 5B are schematic side sectional views showing the meshing of the gears. When the meshing teeth 41C of the drive force distributing gear 41 are at the notch portion 48B of the purge gear 48 and are not meshed with the purge gear 48, the meshing teeth 41A of the drive force distributing gear 41 are meshed with the motor gear 46, the meshing teeth 41B are meshed with the platen gear 12 and the purge gear 48 is meshed with the pump cam gear 25, respectively (see FIG. 5A). In the state where the meshing teeth 41C of the drive force distributing gear 41 are meshed with the purge gear 48, the drive force distributing gear 41 slidably moves toward the purge gear 48 but the above-described gears 12, 41, 46 are kept in the meshed state.

Next, the operation of the carriage 3 and the switching mechanism 30 in the case where maintenance of the nozzle portion of the printing head 2 is carried out will be described with reference to FIGS. 6A to FIG. 18D. FIG. 6A shows the printing area and the capping area for the printing head 2 and the carriage 3 of the printer 1. FIGS. 7A to 18D show the state of the carriage 3, the purge device 15 and the switching mechanism 30 in the case where maintenance of the nozzle portion of the printing head 2 is carried out. The "A" figure of the FIGS. 6_ to 18_ shows the positional relationship between the purge device 15, the carriage 3 and the printing head 2; the "B" figure of the figures shows the positional relationship between the rib 54 at the lower part of the carriage 3 and the kick portion 50; the "C" figure of the figures shows the engagement between the purge gear 48 and the drive force distributing gear 41; and the "D" figure of the figures shows the engagement between the purge gear 48, the drive force distributing gear 41, and the idle kicker 43.

During printing by the printing head 2, the carriage 3 repeats its reciprocating movement within the printing area shown in FIG. 6A. The actual printing is carried out only on the left side of the position indicated by the solid line. The area indicated by A is provided as a rising section necessary for reaching a constant speed again when the carriage 3 temporarily stops in order to change the moving direction. The purge area is provided within the printing area in order to make the dimension of the moving direction of the carriage 3 as small as possible.

Figure 7A:
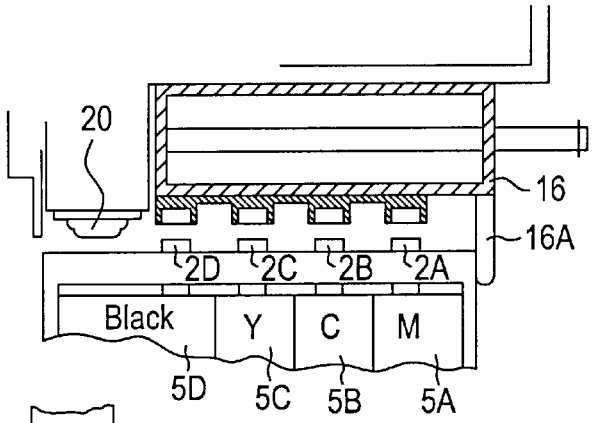
FIGS. 7A, 7B, 7C and 7D are views showing the state of the carriage, the purge device and the switching mechanism in the case where maintenance is to be performed with respect to a nozzle of a printing head.
Figure 7B:
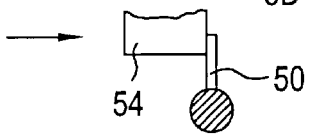
Figure 7C:
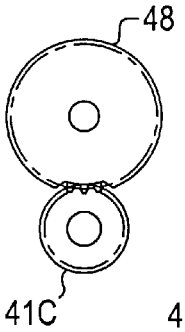
Figure 7D:
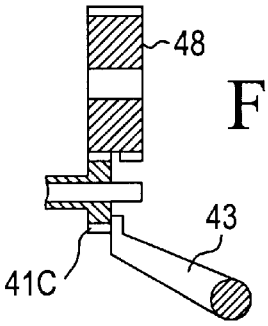

When the carriage 3 moves toward the capping position (externally of the purge operating position, in the direction of right of the figure) and moves into the capping area, the carriage 3 comes into contact with the stop portion 16A of the cap 16 to start capping (see FIG. 7A). At this time, the rib 54 comes in contact with the kick portion 50. When the carriage 3 further moves rightward in FIGS. 8A–8D and reaches the terminal point of the movable range of the carriage 3, the capping of the printing head 2 (nozzles 2A to 2D) by the cap 16 is completed. At this time, the rib 54 kicks the kick portion 50 to turn the idle kicker 43 clockwise (FIG. 8B) so that the drive force distributing gear 41 is released from the bias by the idle kicker 43. Thereby, the meshing teeth 41C are moved rightward (FIG. 8D) by the force of the compression spring 45 and mesh with the purge gear 48.

Figure 8A:
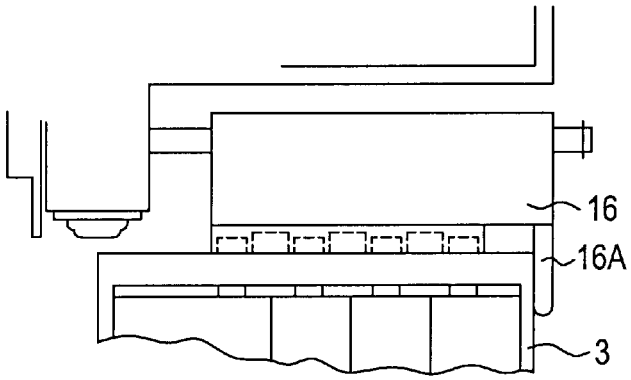
FIGS. 8A, 8B, 8C and 8D are views showing the state of the carriage, the purge device and the switching mechanism in the case where maintenance is performed with respect to a nozzle of a printing head.
Figure 8B:
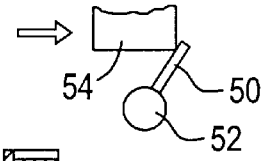
Figure 8C:
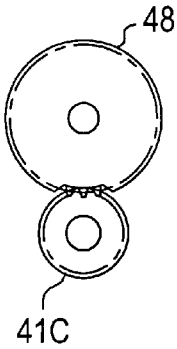
Figure 8D:
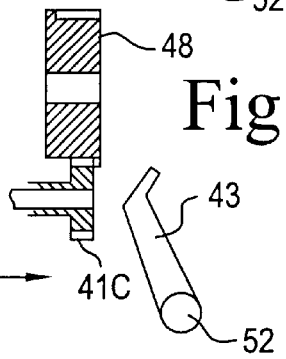
Figure 10A:
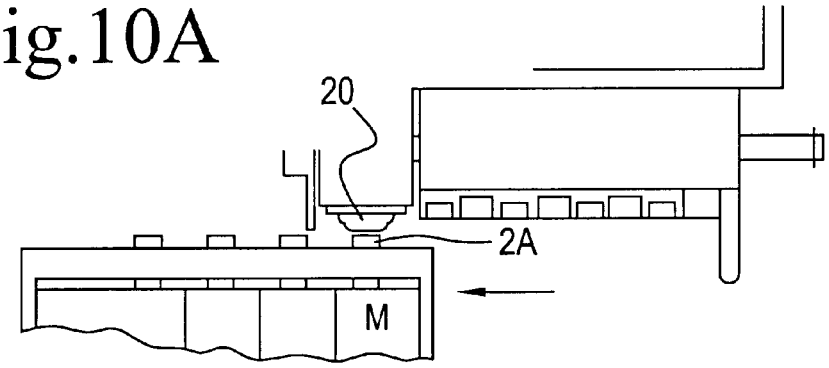
FIGS. 10A, 10B, 10C and 10D are views showing the state of the carriage, the purge device and the switching mechanism in the case where maintenance is performed with respect to a nozzle of a printing head.
Figure 10B:
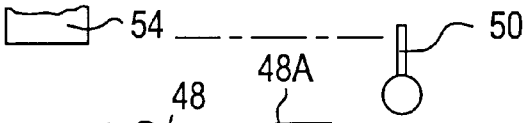
Figure 10C:
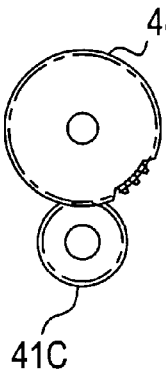
Figure 10D:
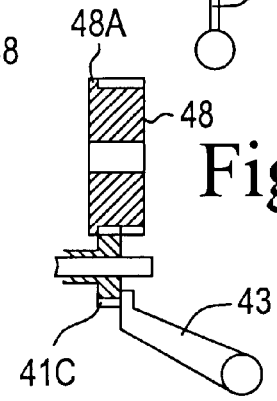
Figures 12A, 12B, 12C, 12D:
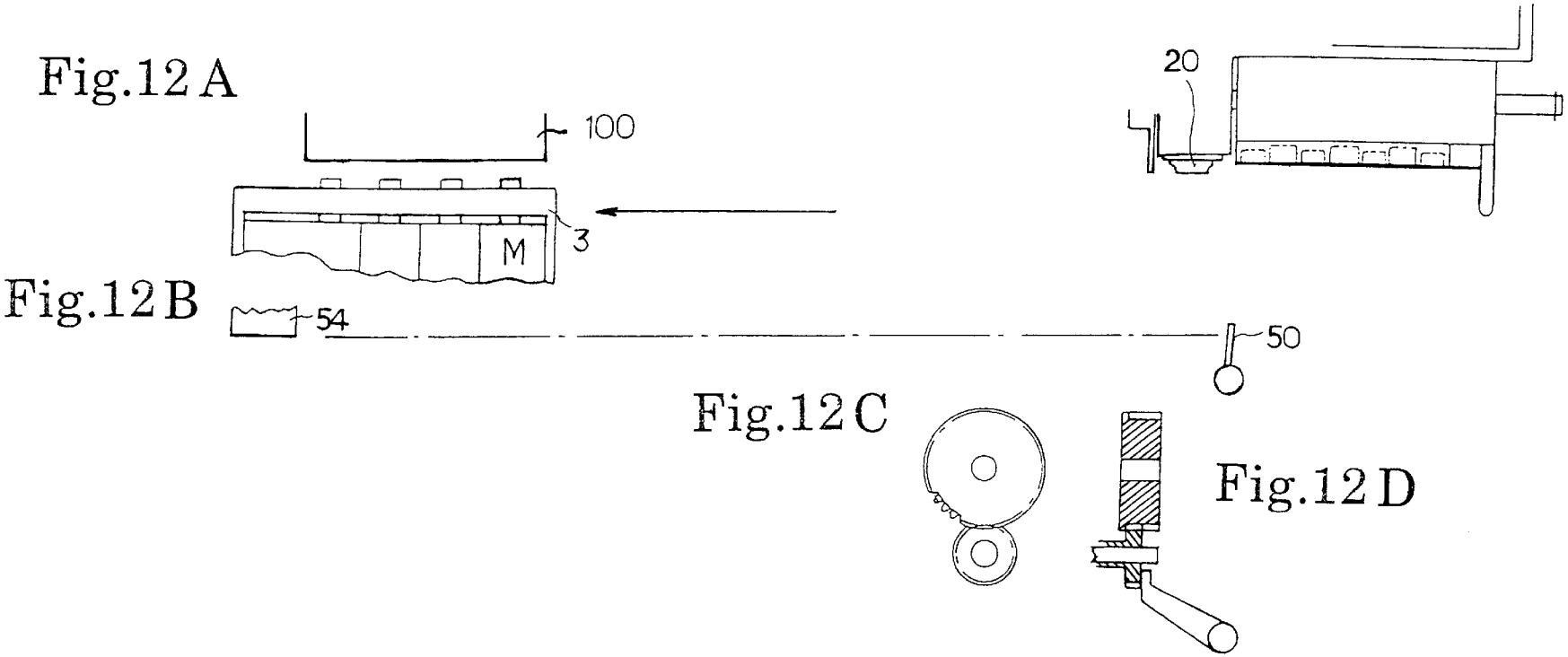
FIGS. 12A, 12B, 12C and 12D are views showing the state of the carriage, the purge device and the switching mechanism in the case where maintenance is performed with respect to a nozzle of a printing head.

When the meshing teeth 41C come into mesh with the purge gear 48, the drive force from the drive force distributing gear 41 is transmitted to the purge gear 48, and the purge gear 48 rotates counterclockwise from the position at which the notch portion 48B corresponds to the meshing teeth 41C (the purge home position) (see FIGS. 8C and 9C). In order to suck the nozzle portion of the printing head 2A when rotated about 45 degrees, the carriage 3 causes the nozzle portion of the printing head 2A to move in the direction of the arrow in FIG. 10A. At this time, the rib 54 is moved away from the kick portion 50 so that the meshing teeth 41C are biased by the idle kicker 43 but the meshing teeth 41C impinge upon the collar 48A of the purge gear 48. Therefore, the meshing teeth 41C are kept in the state where they are meshed with the purge gear 48 (see FIG. 10D). Accordingly, the carriage 3 moves into the printing area again but the drive force is still transmitted from the drive force distributing gear 41 to the purge gear 48 whereby the purge device 15 can be driven.

The following series of operations are carried out. When the carriage 3 moves to the above-described position, the suction cap 20 is caused to advance toward the nozzle portion of the printing head 2A while the purge gear 48 rotates about 270 degrees to effect the suction by the operation of the suction pump (see FIG. 11A-1). After the suction, the wiper 21 is advanced while retracting the suction cap 20 and the carriage 3 is moved by the distance L necessary for wiping the printing head 2A (see FIG. 11A-2, A-3). After completion of the wiping, the wiper 21 is retracted (see FIG. 11A-4).

After completion of the above operation, the carriage 3 moves to a flushing position positioned on the leftmost side of the printing area (a position in which each of the nozzle portions of the printing heads 2A to 2D is opposed to a discharge-ink absorbent 100 for flushing), and flushing (ink is discharged from all the ink discharge holes of the nozzle portions at which restoring operation is completed) of the nozzle portion of the printing head 2A (see FIG. 12A) is accomplished. When the flushing operation is completed, the carriage 3 is returned to the capping position (see FIG. 13A). Thereby, the rib 54 again kicks the kick portion 50, and the meshing teeth 41C are released from the bias by the idle kicker 43. Therefore, even if the notch portion 48B thereafter assumes the position of the meshing teeth 41C, the purge gear 48 is maintained in the state where it is meshed with the meshing teeth 41C.

Figure 15A:
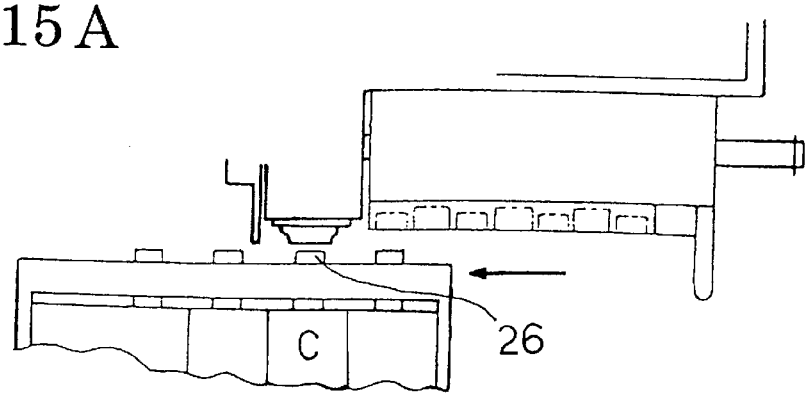
FIGS. 15A, 15B, 15C and 15D are views showing the state of the carriage, the purge device and the switching mechanism in the case where maintenance is performed with respect to a nozzle of a printing head.
Figure 15B:
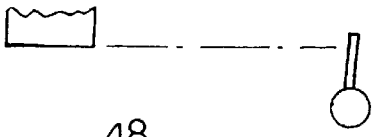
Figure 15C:
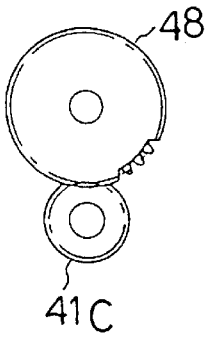
Figure 15D:
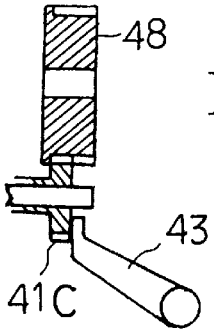
Figure 17A:
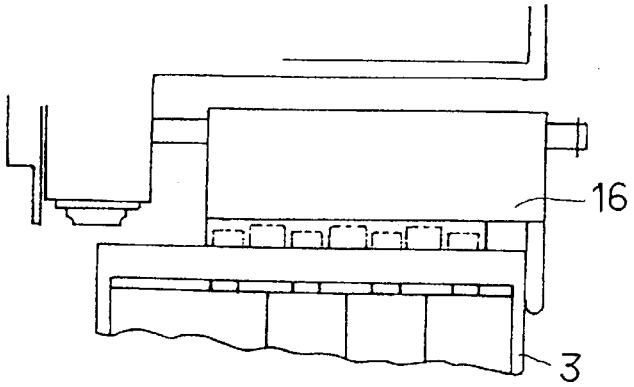
FIGS. 17A, 17B, 17C and 17D are views showing the state of the carriage, the purge device and the switching mechanism in the case where maintenance is performed with respect to a nozzle of a printing head.
Figure 17B:
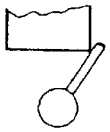
Figure 17C:
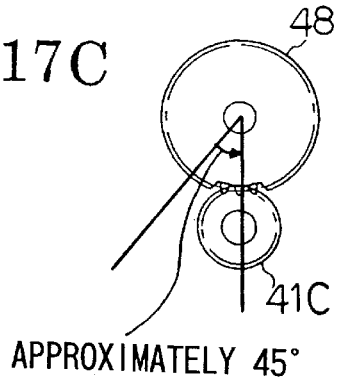
Figure 17D:
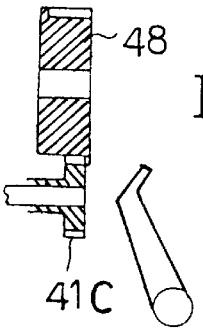

The carriage 3 remains at the capping position until the purge gear 48 rotates about 90 degrees from the FIG. 13C state and the notch portion 48B again assumes a position about 45 degrees on the right side (see FIG. 14C), and when the purge gear 48 assumes a position of about 45 degrees, operations such as suction, wiping and flushing are carried out with respect to the nozzle portion of the printing head 2B so that it moves toward the printing area (arrow in FIG. 15A). At this time, even if the meshing teeth 41C are biased by the idle kicker 43 similarly to the above, the meshing teeth 41C are maintained in the state where they are meshed with the purge gear 48 (see FIG. 15D). When a series of operations such as the suction with respect to the nozzle portion of the printing head 2B is completed, the carriage 3 returns to the capping position (see FIG. 16A).

Thereafter, the operation similar to the above is carried out also with respect to the nozzle portions of the printing heads 2C and 2D, after which the carriage 3 moves to the capping position. Then, the purge gear 48 returns to the initial state, that is, the state where the notch portion 48B corresponds to the meshing teeth 41C, and the maintenance relative to the printing heads 2A to 2D terminates (see FIG. 17B). In this state, the capping is applied to the printing heads 2A to 2D by the protective cap 16 (see FIG. 17A). In the case where after completion of maintenance, printing starts, when the carriage 3 moves to a position shown in FIG. 18A in the direction of the printing area, the meshing teeth 41C slidably move in the notch portion 48B. Accordingly, both the gears are disengaged and released from meshing, and the purge device 15 is not driven. When printing starts, the carriage 3 does not move rightward of the position indicated in FIG. 18A until printing terminates and, therefore, the purge device 15 is not driven.

Figure 19A:
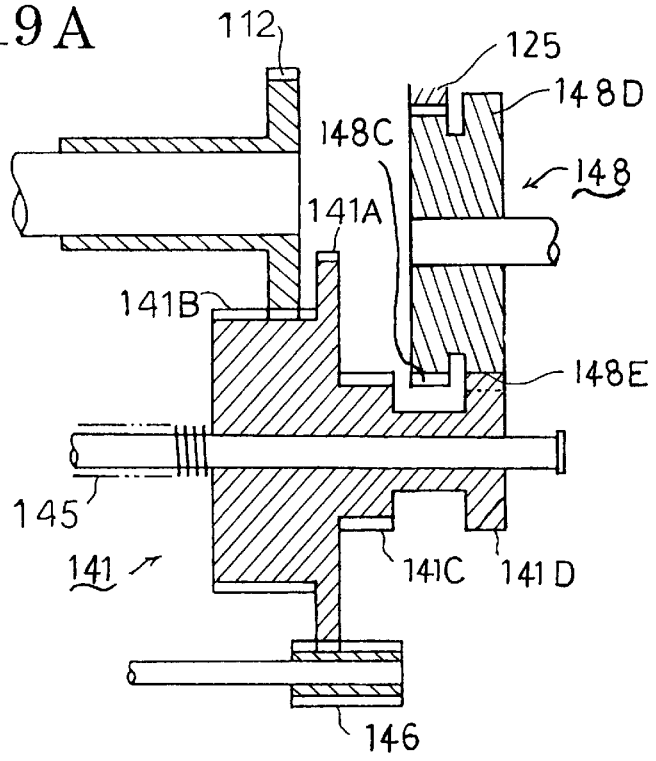
FIG. 19A is a schematic side sectional view showing the state where the purge gear is disengaged from the meshing teeth of the drive force distributing gear.
Figure 19C:
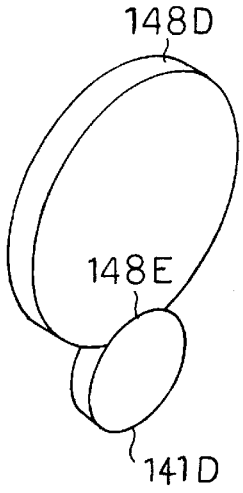
FIG. 19C is a schematic perspective view showing the state where a collar of the purge gear and a disk-like portion of the drive force distributing gear are fitted.
Figure 19B:
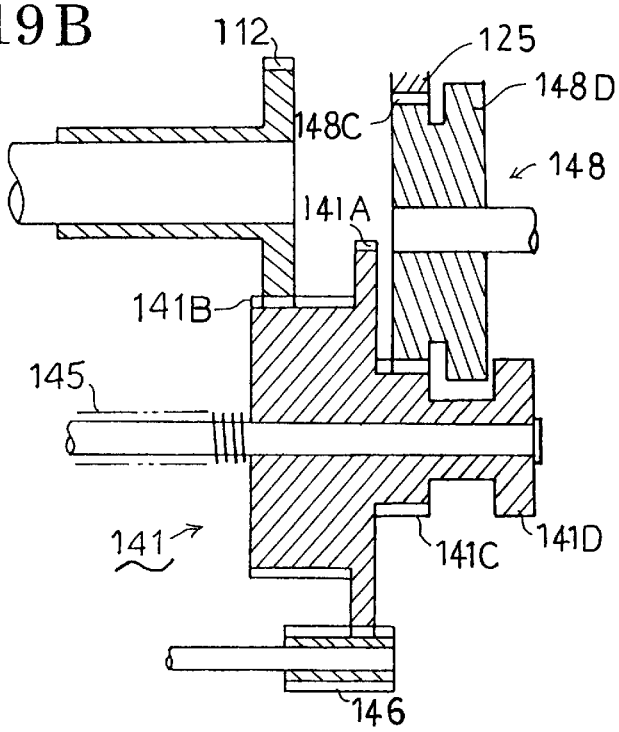
FIG. 19B is a schematic side sectional view showing the state where the purge gear is meshed with the meshing teeth of the drive force distributing gear.

A further embodiment of the switching mechanism 30 will be described hereinafter. FIGS. 19A to 19C are views showing other structural examples of the drive force distributing gear 41 and the purge gear 48, and the meshing of the other gears. FIG. 19A is a schematic side sectional view showing the state where a purge gear 148 is disengaged from meshing teeth 141C of a drive force distributing gear 141C; FIG. 19B is a schematic side sectional view showing the state where the purge gear 148 is meshed with the meshing teeth 141C of the drive force distributing gear 141; and FIG. 19C is a schematic perspective view showing the state where a collar 148D of the purge gear 148 and a disk-like portion 141D of the drive force distributing gear 141 are fitted.

In this embodiment, the purge gear 148 comprises meshing teeth 148C meshed with the meshing teeth 141C of the drive force distributing gear 141, and a disk-like collar 148D provided externally in an axial direction of the meshing teeth 148C so as to be rotated integrally with the purge gear 148 and formed with a notch portion 148E in a part of the outer periphery thereof. The drive force distributing gear 141 is provided with a disk-like portion 141D adjacent to the collar portion 148D and provided so as to be rotated integrally with the drive force distributing gear 141. With the above-described structure, in the case where the purge gear 148 and the drive force distributing gear 141 are disengaged, the disk-like portion 141D is fitted with the notch portion 148E of the collar 148D. When the drive force distributing gear 141 slidably moves in the direction of the purge gear 148 and the meshing teeth 148C of the purge gear 148 mesh with the meshing teeth 141C of the drive force distributing gear 141, the disk-like portion 141D is disengaged from the notch portion 148E of the collar 148D. In this state, when a motor gear 146 is driven, the drive force distributing gear 141 and the purge gear 148 rotate, and the collar 148D also rotates integrally with the purge gear 148.

Since the notch portion 148E is not in a position corresponding to the disk-like portion 141D during the rotation of the purge gear 148 and the collar 148D, the drive force distributing gear 141 cannot be slidably moved, and the meshing teeth 148C of the purge gear 148 cannot be disengaged from the meshing teeth 141C of the drive force distributing gear 141 till the purge gear 148 and the collar 148D rotate about 360 degrees and the notch 148E returns to the position of the initial state. Therefore, in this state, even if the carriage 3 moves to the printing area and the bias caused by the idle kicker 143 is applied to the drive force distributing gear 141, the meshing teeth 148C cannot be disengaged from the meshing teeth 141C till the notch portion 148E returns to the position of the initial state. Accordingly, maintenance can be carried out with respect to the printing heads 2A to 2D similarly to that shown in FIGS. 6 to 18.

Figure 20A:
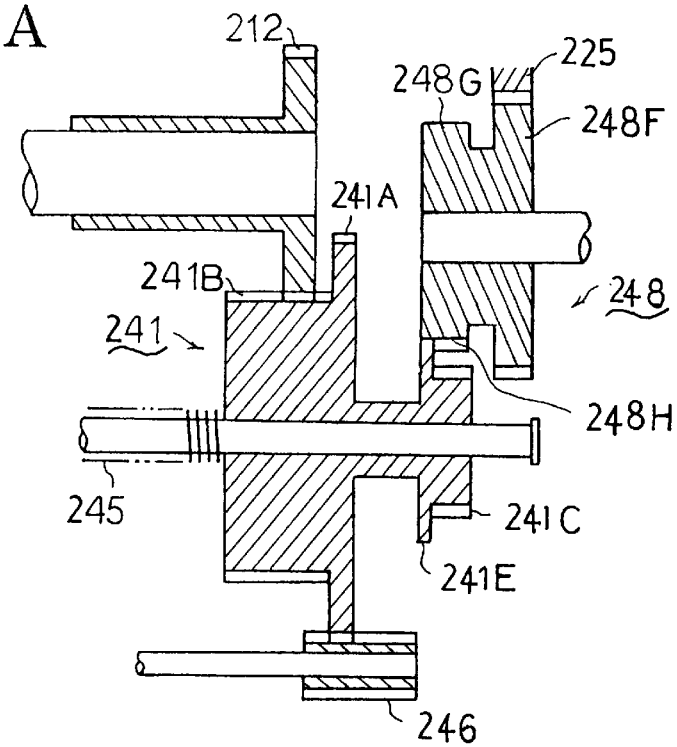
FIG. 20A is a schematic side view showing the state where the purge gear is disengaged from the meshing teeth of the drive force distributing gear.
Figure 20C:
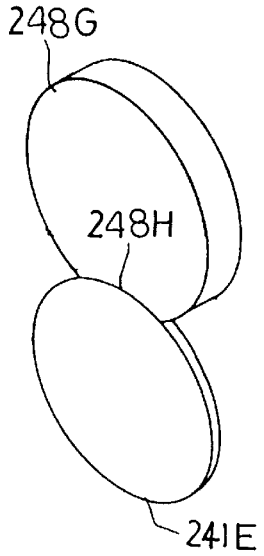
FIG. 20C is a schematic perspective view showing the state where a collar of the purge gear and a disk-like portion of the drive force distributing gear are fitted.
Figure 20B:
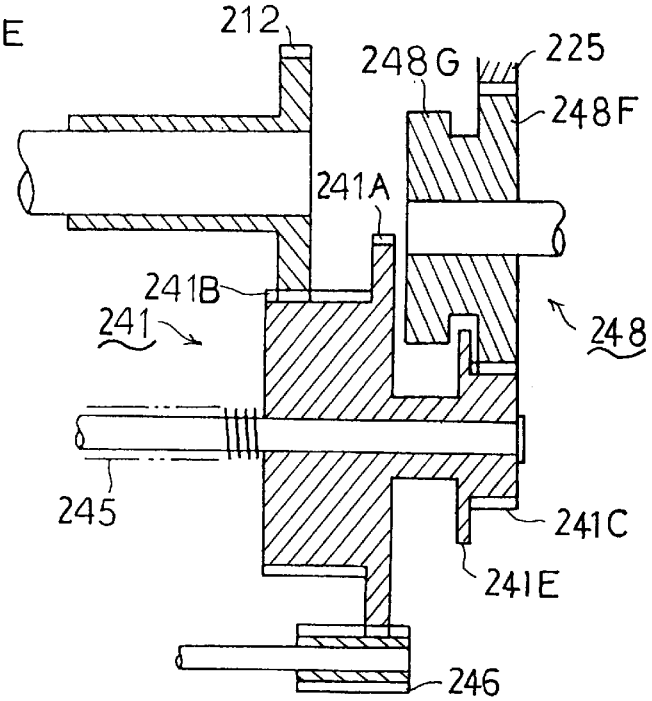
FIG. 20B is a schematic side view showing the state where the purge gear is meshed with the meshing teeth of the drive force distributing gear.

Another embodiment of the switching mechanism 30 will be described below. FIGS. 20A to 20C are views showing another structural example different from the structures of the drive force distributing gear 41 and the purge gear 48, and the meshing with other gears; FIG. 20A is a schematic side view showing the state where a purge gear 248 is disengaged from meshing teeth 241C of the drive force distributing gear 241; FIG. 20B is a schematic side view showing the state where the purge gear 248 is meshed the meshing teeth 241C of the drive force distributing gear 241; FIG. 20C is a schematic perspective view showing the state where a collar 248G of the purge gear 248 and a disk-like portion 241E of the drive force distributing gear 241 are fitted.

In this embodiment, the purge gear 248 comprises meshing teeth 248F meshed with the meshing teeth 241C of the drive force distributing gear 241, and a disk-like collar 248G provided at a position close to the meshing teeth 241C of the drive force distributing gear 241 so as to be rotated integrally with the purge gear and with its outer periphery partly cutaway. The drive force distributing gear 241 is provided with a disk-like portion 241E adjacent to the collar 248G and provided so as to be rotated integrally with the drive force distributing gear 241. In the above-described structure, in the case where the purge gear 248 is disengaged from the drive force distributing gear 241, the disk-like portion 241E is fitted with a notch portion 248H of the collar 248G. When the drive force distribution gear 241 slidably moves in the direction of the purge gear 248, the disk-like portion 241E is disengaged from the notch portion 248H of the collar 248G, and the meshing teeth 248F of the purge gear 248 are meshed with the meshing teeth 241C of the drive force distributing gear 241. In this state, when the motor gear 246 is driven, the drive force distributing gear 241 and the purge gear 248 rotate, and the collar 248G also rotates integrally with the purge gear 248.

Because the notch portion 248H is not in a position corresponding to the disk-like portion 241E during the rotation of the purge gear 248 and the collar 248G, the drive force distributing gear 241 cannot be slidably moved, and the meshing teeth of 248F of the purge gear 248 and the meshing teeth 241C of the drive force distributing gear 241 cannot be disengaged till the purge gear 248 and the collar 248G rotate about 360 degrees and the notch 248H returns to the position of the initial state. Therefore, in this state, even if the carriage 3 moves to the printing area and the bias caused by the idle kicker 43 is applied to the drive force distributing gear 241, the meshing teeth 248F cannot be disengaged from the meshing teeth 241C till the notch portion 248H returns to the position of the initial state. Accordingly, maintenance can be carried out with respect to the printing heads 2A to 2D similarly to that shown in FIGS. 6 to 18.

Figure 21:
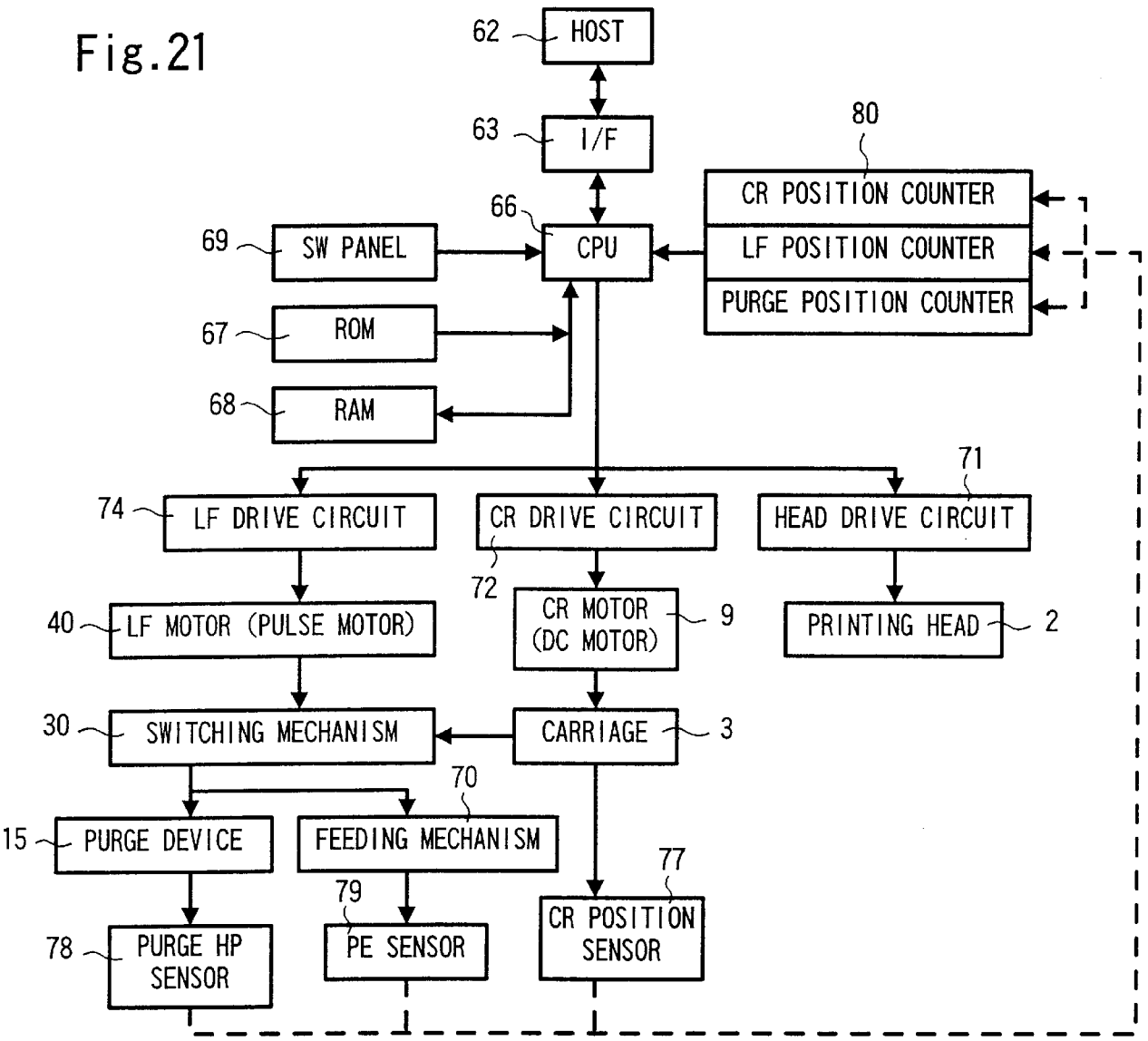
FIG. 21 is a block diagram showing the system structure of the printer provided with a switching mechanism.

The control system of the printer 1 will be described hereinafter. FIG. 21 is a block diagram showing the system configuration of the printer 1. The printer 1 comprises a host computer 62 for outputting printing data to be printed, a CPU (control means) 66 for controlling the printing operation on the basis of the printing data received through an interface 63 from the host computer 62, a ROM 67 for storing a program necessary for operation, and a RAM 68 for temporarily storing the printing data or the like received from the host computer 62. An operating panel 69 for inputting external instructions is connected to the CPU 66.

The printer 1 further comprises the printing head 2, the carriage 3, a feeding mechanism 70 for carrying printing paper and the purge device 15. The operation of the printing head 2 is controlled by the CPU 66 through a head driving circuit 71. The carriage 3 also performs its operation when the carriage (CR) motor 9 is driven through a CR drive circuit 72 under the control of the CPU 66.

The feeding mechanism 70 and the purge device 15 are operated when the line feed (LF) motor 40 is driven by the control of the CPU 66 through an LF (line feed) drive circuit 74. The feeding mechanism 70 and the purge device 15 use in common the LF motor 40 as a driving source through the switching mechanism 30, as previously described. The operation of the carriage 3 and the purge device 15 and the position of the printing paper P carried by the feeding mechanism 70 are detected by a CR position sensor 77, a purge HP (home position) sensor 78 and a PE (paper empty) sensor 79. The detected data are transmitted to the CPU 66 through a counter section 80 comprising a CR position counter, an LF position counter, and a purge position counter to serve as a control reference of the operation of the carriage 3, the purge device 15 and the feeding mechanism 70.

As described above, according to the switching mechanism 30 in the invention, after the carriage 3 moves into the capping area and the drive force distributing gear 41 is meshed with the purge gear 48 to start the rotation thereof, even if the carriage moves into the printing area and the bias caused by the idle kicker 43 is applied to the drive force distributing gear 41, the collar 48A of the purge gear 48 suppresses the sliding movement of the meshing teeth 41C so that the purge gear 48 and the meshing teeth 41C are maintained in their meshed state. Accordingly, the drive force from the LF motor 40 is transmitted to the purge device 15, and the suction operation of the printing head 2 with respect to the nozzle portion caused by the suction cap 20 becomes enabled. If the maintenance operation of the printing head 2 with respect to the nozzle portion is set to be completed when the purge gear 48 rotates once (in the substantial operation, rotation of about 270 degrees) and is set so that the carriage 3 returns to the home position after termination of the maintenance of the respective nozzles, the purge gear 48 and the meshing teeth 41C can be maintained in the meshed state till the maintenance with respect to all the nozzle portions terminates even in the case where the carriage 3 has to move over the capping area and the printing area in order to perform the maintenance with respect to the respective nozzle portions.

The invention is not limited to the above-described embodiments but can be variously modified. For example, while in the above-described embodiment, the drive force distributing gear 41 is slidably moved in the direction of the purge gear 48 by the force of the compression spring 45, it is to be noted that the purge gear 48 may be moved in the direction of the drive force distributing gear 41. Further, while in the above-described embodiment, the platen gear 12 coaxial with the platen roller 11 is always meshed with the meshing teeth 41B of the drive force distributing gear 41, it is to be noted that when the meshing teeth 41C are meshed with the purge gear 48, the platen gear 12 may be disengaged from the meshing teeth 41B.

Moreover, as described above, the maintenance operation is carried out with respect to all of the nozzle portions of the printing heads 2A to 2D, it is to be noted that the maintenance operation may be carried out with respect to only selected nozzle portions of the printing heads 2A to 2D. Further, while with respect to the maintenance operation, the suction by the suction cap 20, the wiping by the wiper 21 and the flushing are continuously performed with respect to one nozzle portion of the printing heads 2A to 2D, and after completion of a series of operations, the series of operations are sequentially performed with respect to the other nozzle portions, it is to be noted that after the suction and wiping operations have been performed with respect to the respective nozzle portions of the printing heads 2A to 2D, the flushing of the respective nozzle portions of the printing heads 2A to 2D may be performed.

What is claimed is:

1. A recording apparatus, comprising:

a negative pressure generating mechanism that generates a negative pressure in a suction cap for covering a nozzle portion of a printing head;

a recording medium carrying mechanism that carries a recording medium;

a driving source for driving said negative pressure generating mechanism and said recording medium carrying mechanism; and a drive transmission switching mechanism that switches a drive force of said driving source into a state for transmitting the drive force to the negative pressure generating mechanism and into a state for not transmitting the drive force to the negative pressure generating mechanism while transmitting the drive force in both states to the recording medium carrying mechanism, further comprising:

a drive force transmission gear to which the drive force of said driving source is transmitted;

a negative pressure gear for transmitting the drive force of said driving source from said drive force transmission gear to said negative pressure generating mechanism a drive transmission switch device that axially slidably moves at least one gear of said drive force transmission gear and said negative pressure gear to enable switching into a position to mesh with the other gear and into a position to disengage therefrom; and an allowing mechanism that permits the sliding movement of said one gear from the mesh position to the disengage position by said drive transmission switch device and the sliding movement from the disengage position to the mesh position.

2. The drive transmission switching mechanism in said recording apparatus as claimed in claim 1, wherein said allowing mechanism comprises a collar provided on the meshing teeth side of said negative pressure gear adjacent to said drive force transmission gear and having a part of an outer periphery thereof cutaway.

3. The drive transmission switching mechanism in said recording apparatus as claimed in claim 2, wherein said drive force transmission gear remains at said cutaway portion of said collar when the drive force transmission gear is disengaged from the meshing teeth of said negative pressure gear by said sliding movement.

4. The drive transmission switching mechanism in said recording apparatus as claimed in claim 2, wherein said collar portion rotates integrally with said negative pressure gear, and said allowing mechanism further comprises a disk-like portion that rotates integrally with said drive force transmission gear adjacent to said collar portion and fitting in the cutaway portion of said collar portion.

5. The drive transmission switching mechanism in said recording apparatus as claimed in claim 4, wherein said disk-like portion maintains the state of fitting in the cutaway portion of said collar portion when the drive force transmission gear is disengaged from the meshing teeth of said negative pressure gear by the sliding movement of said drive force transmission gear.

6. The drive transmission switching mechanism in said recording apparatus as claimed in claim 1, wherein said drive transmission switch device that axially slidably moves at least one gear of said drive force transmission gear and said negative pressure gear when a carriage having said printing head mounted thereon moves outside the printing area to switch the at least one gear from a position disengaged from the other gear to a meshed position.

7. The drive transmission switching mechanism in said recording apparatus as claimed in claim 1, wherein said drive transmission switch device that axially slidably moves at least one gear of said drive force transmission gear and said negative pressure gear when a carriage having said printing head mounted thereon moves to a position at which the nozzle portion of said printing head is capped by a protective cap provided further externally of said suction cap to switch the at least one gear from a position disengaged from the other gear to a meshed position.

8. The drive transmission switching mechanism in said recording apparatus as claimed in claim 1, wherein the carriage having said printing head mounted thereon has a plurality of printing heads for jetting different color inks mounted in a line in a moving direction of the carriage.

9. The recording apparatus as claimed in claim 1, wherein said drive transmission switching mechanism comprises a kicker assembly having an idle kicker biased to disengage said at least one gear from the other gear and a kick portion for overcoming the bias of the idle kicker.

10. A drive switching mechanism for engaging and disengaging transmission of a drive force from a drive source in a printer, comprising:

a motor gear connected to an output shaft of the drive source;

a drive force distributing gear having at least a first set of meshing teeth, a second set of meshing teeth engaged with the motor gear by way of the first set of meshing teeth, and a third set of meshing teeth engaged with the motor gear by way of the first set of meshing teeth;

a negative pressure generating mechanism;

an operational gear for selectively engaging with the second set of meshing teeth to drive the negative pressure generating mechanism;

a first biasing mechanism that biases the second set of meshing teeth into engagement with the operational gear;

a second biasing mechanism that biases the second set of meshing teeth out of engagement with the operational gear;

a kicker engagement mechanism that engages and disengages the second biasing mechanism from the drive force distributing gear; and a locking mechanism to retain the second set of meshing teeth in engagement with the operational gear, wherein the third set of meshing teeth are always engaged with a driving gear for a recording medium carrying mechanism of the printer.

11. The drive switching mechanism as claimed in claim 10, wherein said second biasing mechanism exerts a greater force than said first biasing mechanism.

12. The drive switching mechanism as claimed in claim 10, wherein said locking mechanism comprises a flange on one of the operational gear and the drive force distributing gear.

13. The drive switching mechanism claimed in claim 12, wherein the flange is formed on the operational gear on a side facing the second set of meshing teeth, the flange having a notch allowing the second set of meshing teeth to pass therethrough to engage with the operational gear.

14. The drive switching mechanism as claimed in claim 12, wherein the flange is on operational gear and the drive force distributing gear has an engagement flange for engaging with the flange on the operational gear.

15. The drive switching mechanism as claimed in claim 14, wherein the flange on the operational gear has a concave notch allowing a segment of the engagement flange to pass therethrough.

16. The drive switching mechanism as claimed in claim 10, wherein the first biasing mechanism and the second biasing mechanism act in opposite axial directions to move the drive force distributing gear laterally along a rotational axis of the drive force distributing gear.

* * * * *